US006394916B1

(12) United States Patent
Doucettperry

(10) Patent No.: US 6,394,916 B1
(45) Date of Patent: May 28, 2002

(54) ALL-IN-ONE GOLF BALL MARKER AND POSITION INDICATOR

(76) Inventor: James Doucettperry, 1601 Carmelita Dr., Sierra Vista, AZ (US) 85636

( * ) Notice: Subject to any disclaimer, the term of this patent is extended or adjusted under 35 U.S.C. 154(b) by 0 days.

(21) Appl. No.: 09/549,744

(22) Filed: Apr. 14, 2000

(51) Int. Cl.[7] ..... A63B 57/00

(52) U.S. Cl. ..... 473/406; 473/407; 473/257; 473/272; 473/285

(58) Field of Search ..... 473/406, 407, 473/285, 409, 257, 218, 272, 273

(56) References Cited

U.S. PATENT DOCUMENTS 3,203,700 A * 8/1965 Antonious
3,347,551 A * 10/1967 Dreyfus
5,356,133 A * 10/1994 Bellagamba
5,529,299 A * 6/1996 Bellagamba
6,017,282 A 1/2000 Stefonsky ..... 473/406

* cited by examiner

*Primary Examiner*—Paul T. Sewell
*Assistant Examiner*—Nini F. Legesse
(74) *Attorney, Agent, or Firm*—Durando Birdwell & Janke, P.L.C.; Gavin J. Milczarek-Desai

(57) ABSTRACT

A method and device for marking and keeping track of the correct location of a golf ball. The marking device includes a two-sided body, with the first side displaying an indication to play the ball from the present location of the marker and the second side displaying an indication to remark the location of the ball before it is played, and a means of securing the body to the ground. The method utilizes the two-sided body to remind a golfer of the correct position of his or her ball.

7 Claims, 3 Drawing Sheets

ALL-IN-ONE GOLF BALL MARKER AND POSITION INDICATOR

BACKGROUND OF THE INVENTION

1. Field of Invention

This invention generally relates to the field of golfing accessories and in particular to a device and method for marking the position of a golf ball.

2. Description of the Related Art

During a game of golf, there are several situations in which a player will temporarily remove his or her ball from the course. To help ensure accuracy, the player replaces the ball with some type of marker. A typical ball marker may consist simply of a coin-like body. More elaborately, the body of the marker may be made in any one of a wide variety of geometric shapes, such as polygonal or annular discs, with a pin attached to the bottom surface of the marker for securing it to the ground. The top surface of the body may display a design or writing that serves a decorative or owner identification purpose.

Often, removing and replacing a ball is straightforward, such as when a ball needs to be cleaned. In this situation, a player picks up his or her ball, places a marker to denote the ball's location, and then replaces the ball when cleaning is finished.

While the design and structure of a typical marker is suitable for the simple replacement of a ball, it is not ideal for more complicated situations.

Such a situation exists when several golfers are on the same putting green. According to Rule 10-1 of the USGA rules, the golfer furthest from the hole is to putt first. However, sometimes another player's ball is in his "line of putt," that is, the path between the putting player's ball and the cup. Placement of a marker where the fellow competitor's ball lies is not allowed, because it would still constitute an impermissible obstruction in the line of putt.

Consequently, the intervening ball cannot simply be removed and replaced with a marker; the marker itself must be placed out of the putting player's line of putt. This is accomplished by re-positioning the marker such that it is a certain number of "club-heads"0 (i.e., the length of a potter) away from the original location of the ball. Then, when it is time to replace the ball, the golfer must move back or "re-mark" the ball to its original location before putting (Rule 20-1). Failure to do so causes the offending player to incur a two-stroke penalty (Rule 5-1).

Given that there are several reasons why a golfer removes the ball and places a marker, a player sometime forgets that the golf ball must be re-positioned in certain situations prior to his next stroke. U.S. Pat. No. 6,017,282 by Stefonsky provides a two-piece golf ball position marking system that includes a marker and a separate repositioning aid. However, if one of the pieces becomes lost, this system no longer distinguishes between a ball that has simply been picked-up versus one that has been moved and needs to be re-marked. In other words, one would be left with either an ordinary marker or a re-positioning arrow. Moreover, this system does not provide a way to remind a golfer of the distance that a ball has been moved, and, therefore, the distance that it must be re-marked.

Thus, it is desirable to provide a simple, all-in-one means of marking a ball's location and of selectively indicating that the position of the ball needs to be re-marked a predetermined distance before the player proceeds.

SUMMARY OF THE INVENTION

Most broadly, the invention meets the aforementioned need by providing a new method utilizing a device that simultaneously marks a ball's location and displays to a golfer an indication of whether to replace the marker with the ball and proceed or to first re-mark the ball to another location.

Preferably, the device includes a first side having an indication to play a ball from where it lies, a second side having an indication to re-mark a ball to its former position before continuing play, and means of attaching either side firmly to the ground.

Also preferably, the device may include an indication of how many club heads of distance a player must re-mark his ball before proceeding and an arrow or arrowhead for pointing out the direction in which re-marking should occur.

An advantage of this invention is that it provides in a single device a way to either mark a ball's actual location or to mark a temporary location with an indication to re-mark the ball.

A second advantage of this invention is that it combines a ball marker and position reminder with an indicator of re-mark distance and direction, thus minimizing the possibility of a penalty resulting from inaccurate ball placement.

Accordingly, it is a principal object of the invention to provide a new golf ball marker and position reminder device and method.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DETAILED DESCRIPTION OF THE INVENTION

The invention in general provides an all-in-one device that allows a golfer to both mark the position of his or her ball and to remember, when appropriate, to re-mark the ball to its original position, such as after moving a marker to clear the line of putt for a fellow competitor.

Figure 1A:
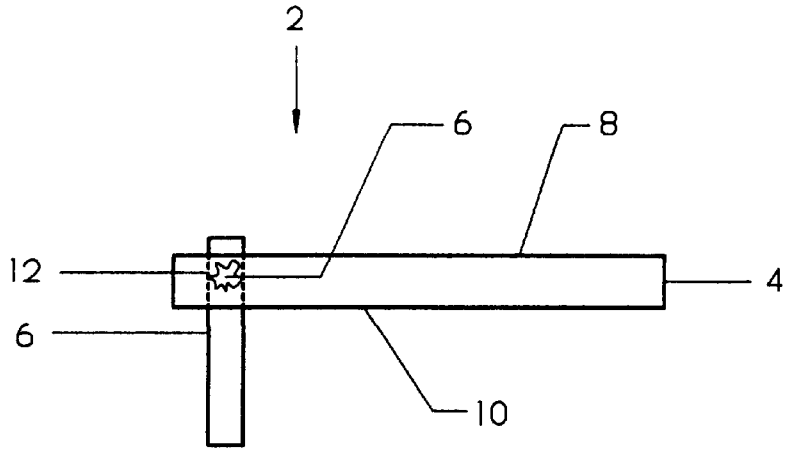
FIG. 1A is an elevational side view of a preferred embodiment of the invention.

As depicted in FIG. 1A, a preferred marker and position reminder device 2 generally comprises a substantially flat, two-sided body 4 and a rod 6. More particularly, the body 4 includes a first side 8 and an opposing second side 10.

Although not clearly pictured in this view, both of the sides 8 and 10 are perforated by a hole 12 (shown in phantom line) through which the rod 6 passes. The hole 12 is sized to frictionally engage the rod 6 so that it can move, but not fall out. Thus, the rod 6 is vertically slidable through the hole 12 so that it may protrude from either side 8 or 10, depending on which of the two sides will be face-up when the device 2 is secured to the ground.

Figure 1B:
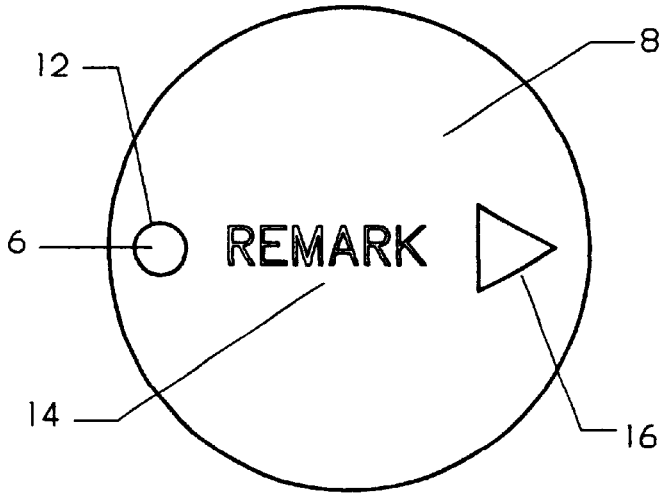
FIG. 1B is a top view of the device of FIG. 1A.

With reference to FIG. 1B, the first-side 8 includes an indication 14 that the golf ball needs to be repositioned, in this case the word "REMARK." Furthermore, the first side 8 has an arrowhead 16 to point out the direction in which re-marking should take place.

Figure 1C:
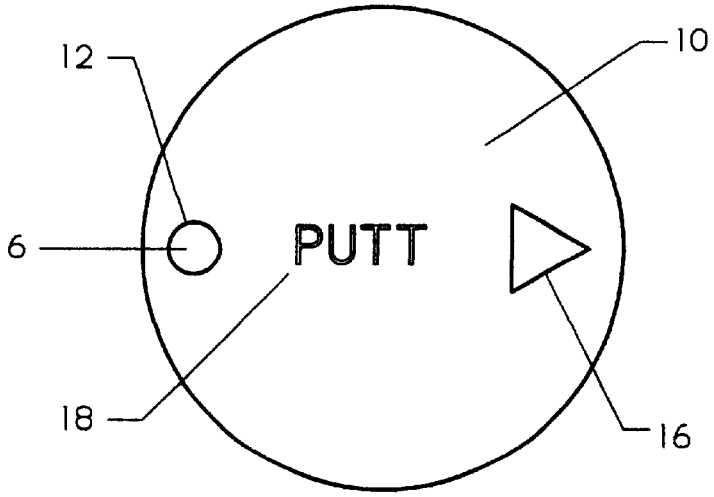
FIG. 1C is a bottom view showing the opposite side of the device of FIG. 1B.

In FIG. 1C, the second side 10 has an indication 18 to play the ball from its currently marked position, in this case the word "PUTT." The second side 10 also includes an arrowhead 16 to remind the golfer of the direction of his line of putt.

Figure 2:
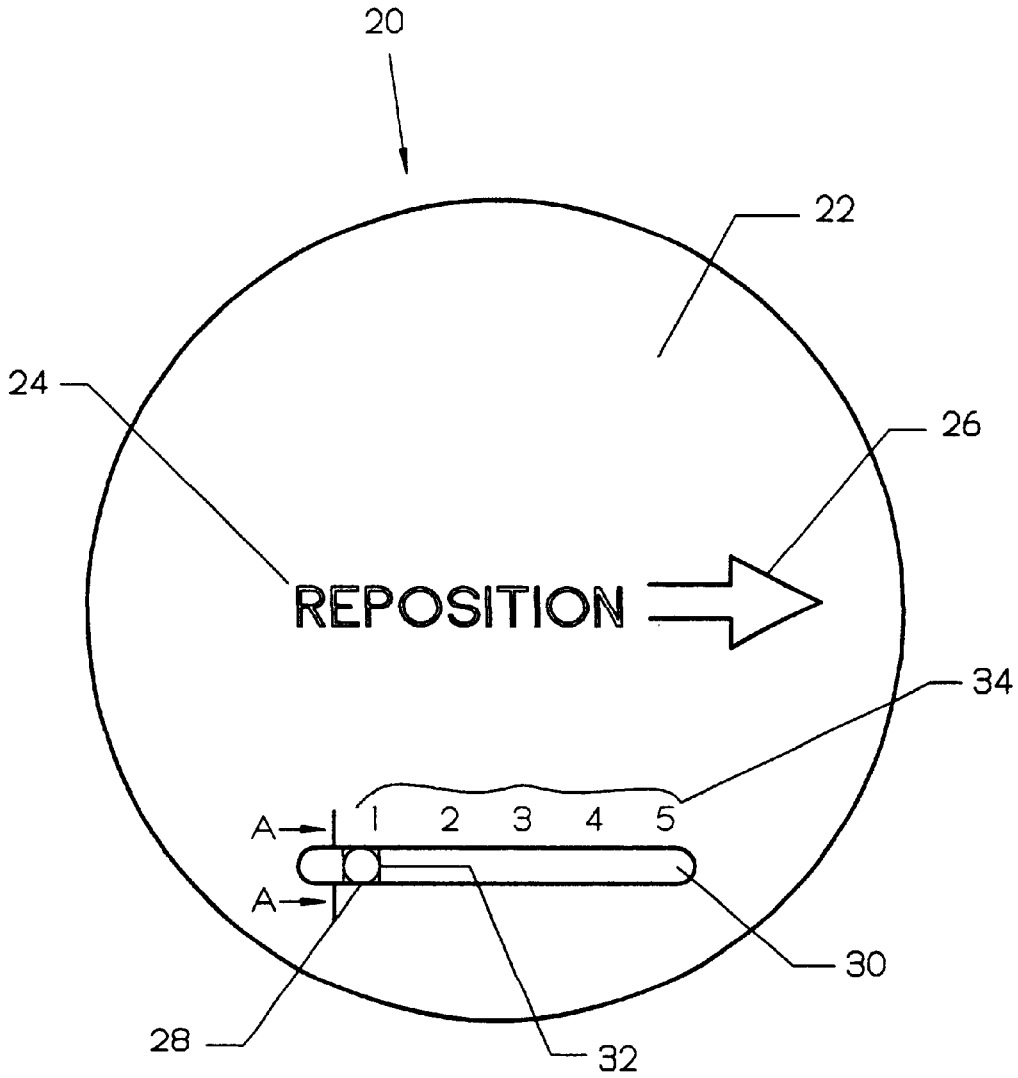
FIG. 2 is a top view of second preferred embodiment of the invention.

A second preferred embodiment of the invention is shown in FIG. 2. The body 20 has a first side 22 with an indication 24 to re-position a golf ball and an arrow 26 to point out the direction in which the ball is to be re-marked. Furthermore, the body 20 includes a rod 28 positioned within a slot 30. The rod 28 is secured within the slot 30 by a slidable holder 32. The holder 32 and the rod 28 are sized to frictionally engage each other such that the rod 28 may slide vertically, as in the first embodiment of the invention. Similarly, the holder 32 is designed so that it can slide horizontally without falling out. This can be achieved, for example, by a tongue and groove mechanism (not shown in this view; see FIG. 3). Moreover, the first side 22 includes distance marks 34 to remind a golfer how many club heads or other predetermined unit of distance a ball must be moved to re-mark it to its original position. As with the first preferred embodiment shown in FIG. 1, the body 20 has a second side with an indication to proceed with play (not shown).

Figure 3:
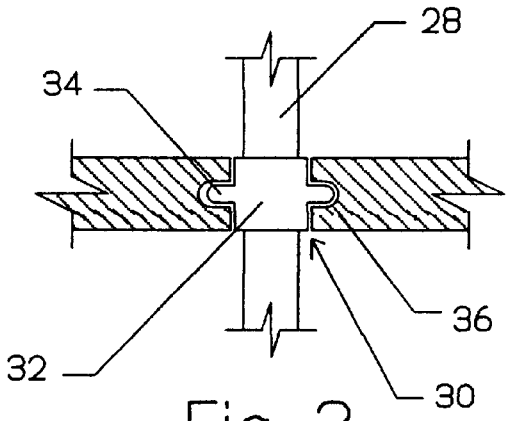
FIG. 3 is an enlarged cross-sectional view taken along the line A—A in FIG. 2.

FIG. 3 shows an enlarged cross-sectional view of the rod 28 and the holder 32 assembly. The holder 32 allows the rod 28 to be moved horizontally within the slot 30 by virtue of two tongues 34 in the holder 32 slidably engaged by corresponding grooves 36 in the slot 30.

Figure 4A:
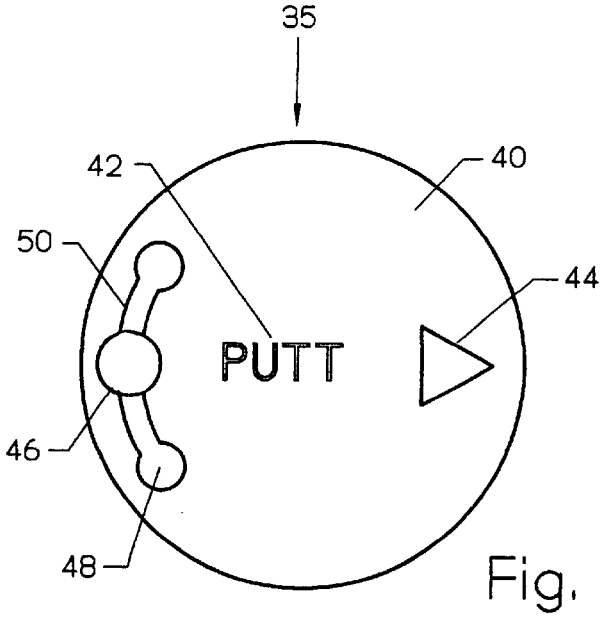
FIG. 4A is a top view of a third preferred embodiment of the invention.
Figure 4B:
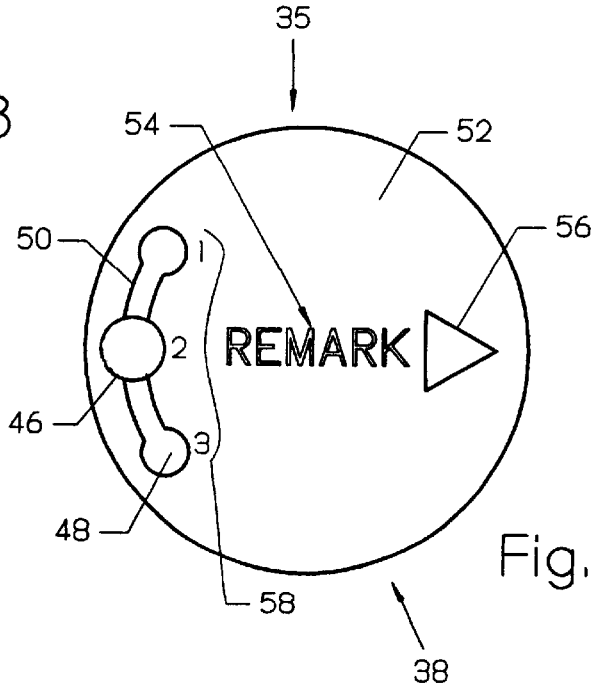
FIG. 4B is a bottom view showing the opposite side of the device of FIG. 4A.

Turning to FIG. 4A, a third preferred embodiment is shown that includes a body 38 having a first side 40 with an indication 42 to proceed with play, a directional arrowhead 44, and a rod 46 positioned inside one of several stops 48 of a slot 50. On the opposite side the body 38 is a second side 52 as shown in FIG. 4B. The second side 52 has an indication 54 to re-mark a golf ball, a directional arrowhead 56, and a rod 46 positioned inside a stop 48 of the slot 50.

Figure 5A:
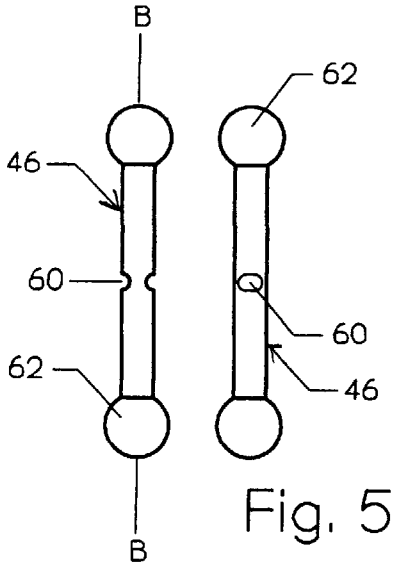
FIG. 5A is an enlarged side view of the rod element of FIGS. 4A and 4B.
Figure 5B:
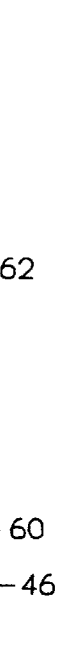
FIG. 5B is a side view of the rod shown in FIG. 5A after it has been rotated 90° along the axis defined by the line B—B.

The second side 52 also includes distance marks 58 to remind a golfer how many club heads or other predetermined unit of distance a ball must be moved to re-mark it to its original position. As seen in FIGS. 5A and 5B, the rod 46 is designed to slide in a direction that is parallel to the sides 40 and 52 by frictionally engaging the slot 50 with the notches 60. As shown, the notches 60 are disposed on opposite sides of the rod 46 but do not extend around the entire circumference. Thus, the rod 46 can also frictionally engage a stop 48 of the slot 50 to become slidable in a direction perpendicular to the sides 40 and 52. End caps 62 are preferably provided to prevent the rod 46 from falling out of a stop 48.

To practice the method of the invention in general, a golfer either (1) replaces the ball where it lies and secures the marker with the side displaying an indication to replace the ball and continue play face-up or (2) measures a predetermined number of club heads from the ball and places the marker face-up on the side displaying an indication to re-mark the ball in a particular direction. In the second and third preferred embodiments, the play also adjusts the rod to the marking that indicates the unit(s) of distance that the ball will be re-marked.

The invention is particularly inexpensive and simple to manufacture from commonly-available commercial materials. Although the invention could be constructed out of a variety of materials, such as wood or metal, it is preferably molded of a lightweight yet resilient material, such as polypropylene. Additionally, the invention may be constructed in many different sizes. Preferably, the body is manufactured to be 1.25 inches in diameter and ⅛ of an inch in thickness. Also preferably, the rod is manufactured to be ¾ of an inch in length and one-eighth of an inch in width.

As would be understood by those skilled in the art, any number of functional equivalents may exist in lieu of the preferred embodiments described above. For example, in addition to, or in lieu of, a word, one side of the embodiments described above may be colored red as an indication that the player must "stop" and re-mark the ball prior to the next shot. Similarly, the opposite side may be colored green to indicate that it is alright for the player to "go" ahead with play. Moreover, the structure that is used to secure the body to the ground may include any means known for that purpose, such as one or more pins or burrs.

Thus, as will be apparent to those skilled in the art, changes in the design, configuration, or materials that have been described may be made within the principles and scope of the invention illustrated herein and defined in the appended claims. Therefore, while the present invention has been shown and described in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent products.

I claim:

1. A device for marking a position of a golf ball, comprising:

a body that includes a first side displaying thereon an indication to play the ball from said position and a second side displaying thereon an indication to re-mark the location of the ball from said position; and a rod joined to the body for securing either side of said body to the ground, wherein said rod is slidably connected to the body through frictional engagement with an opening in the body.

2. The device of claim 1, wherein the first side displays an indication selected from the group consisting of colors, alphanumeric symbols, arrows or combinations thereof.

3. The device of claim 1, wherein the second side displays an indication selected from the group consisting of colors, alphanumeric symbols, arrows or combinations thereof.

4. The device of claim 1, wherein said rod is slidable in a direction perpendicular to said first and second sides.

5. The device of claim 1, wherein said rod is slidable in a direction in a plane parallel to said first and second sides.

6. The device of claim 5, wherein said first side of the device further includes an indication of a distance by which the ball is to be re-marked.

7. The device of claim 1, wherein said first side of the device further includes an indication of a distance by which the ball is to be re-marked.

* * * * *